US007782278B2

(12) United States Patent
Chiou

(10) Patent No.: US 7,782,278 B2
(45) Date of Patent: Aug. 24, 2010

(54) INTRA-PIXEL CONVOLUTION FOR AMOLED

(75) Inventor: Yu-Wen Chiou, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 795 days.

(21) Appl. No.: 11/610,713

(22) Filed: Dec. 14, 2006

(65) Prior Publication Data

US 2008/0143654 A1 Jun. 19, 2008

(51) Int. Cl.
*G09G 3/32* (2006.01)
*G09G 3/30* (2006.01)
*G09G 3/10* (2006.01)

(52) U.S. Cl. ..... 345/82; 345/76; 315/169.3

(58) Field of Classification Search ..... 345/76–83; 315/169.3

See application file for complete search history.

(56) References Cited

U.S. PATENT DOCUMENTS

| | | | | |
|---|---|---|---|---|
| 6,049,321 | A * | 4/2000 | Sasaki | 345/99 |
| 6,919,871 | B2 * | 7/2005 | Kwon | 345/92 |
| 2005/0017934 | A1 | 1/2005 | Chung et al. | |
| 2006/0023551 | A1 * | 2/2006 | Peng et al. | 365/226 |

* cited by examiner

*Primary Examiner*—Bipin Shalwala
*Assistant Examiner*—Ilana Spar
(74) *Attorney, Agent, or Firm*—J.C. Patents

(57) ABSTRACT

A pixel array comprising a plurality of pixel groups, wherein each pixel group comprises: A plurality of light emitting elements, a plurality of driving units, and a plurality of switching units. A plurality of driving units, each of which outputs drives currents for the light emitting elements in a convolution sequence. Each of switching units couples the output of one of the driving units to the light emitting elements in the convolution sequence.

17 Claims, 13 Drawing Sheets

INTRA-PIXEL CONVOLUTION FOR AMOLED

BACKGROUND OF THE INVENTION

1. Field of Invention

The present invention relates to intra-pixel convolution, and more particularly to intra-pixel convolution for AMOLED.

2. Description of Related Art

The use of organic materials in the electronics industry has increased recently and has led to low cost, high performance displays. Enhanced performance, such as increased luminance, has been achieved by using OLEDs. Furthermore, active-matrix OLEDs have been developed, resulting in brighter, larger and higher resolution OLED displays that dissipate less power than passive-matrix displays. However, the non-uniformity of the threshold voltage and mobility among the driving transistors seriously degrades the performance of the AMOLED display. Thus, a new AMOLED driving mechanism eliminating the non-uniformity issue is necessary.

SUMMARY OF THE INVENTION

An objective of the present invention is to provide a mechanism for driving an AMOLED display, which eliminating the performance degradation resulting from the non-uniformity of the threshold voltage and mobility.

The present invention provides a pixel array comprising a plurality of pixel groups, wherein each pixel group comprises a plurality of light emitting elements, a plurality of driving units, and a plurality of switching units. Each of the driving units outputs driving currents for the light emitting elements in a convolution sequence. Each of switching units couples the output of one of the driving units to the light emitting elements in the convolution sequence.

The present invention also provides a method for driving a display having a pixel array comprising a plurality of pixel groups, wherein each pixel group comprises a plurality of light emitting elements and a plurality of driving units, and the driving units are connected to data and scan lines to receive data and scan signals so that driving currents are generated in response to the data and scan signals, the method comprising the steps of outputting driving currents for the light emitting elements by the driving units in a convolution sequence, and coupling outputs of the driving units to the light emitting elements in the convolution sequence, wherein the driving units of each pixel group are connected to three adjacent data lines and two adjacent scan lines.

The present invention further provides another method for driving a display having a pixel array comprising a plurality of pixel groups, wherein each pixel group comprises a plurality of light emitting elements and a plurality of driving units, and the driving units are connected to data and scan lines to receive data and scan signals so that driving currents are generated in response to the data and scan signals, the method comprising the steps of outputting driving currents for the light emitting elements by the driving units in a convolution sequence, and coupling outputs of the driving units to the light emitting elements in the convolution sequence, wherein the driving units of each pixel group are connected to two adjacent data lines and three adjacent scan lines.

In order to make the aforementioned and other objects, features and advantages of the present invention comprehensible, preferred embodiments accompanied with figures are described in detail below.

BRIEF DESCRIPTION OF THE DRAWINGS

The accompanying drawings are included to provide a further understanding of the invention, and are incorporated in and constitute a part of this specification.

DESCRIPTION OF EMBODIMENTS

Figure 1:
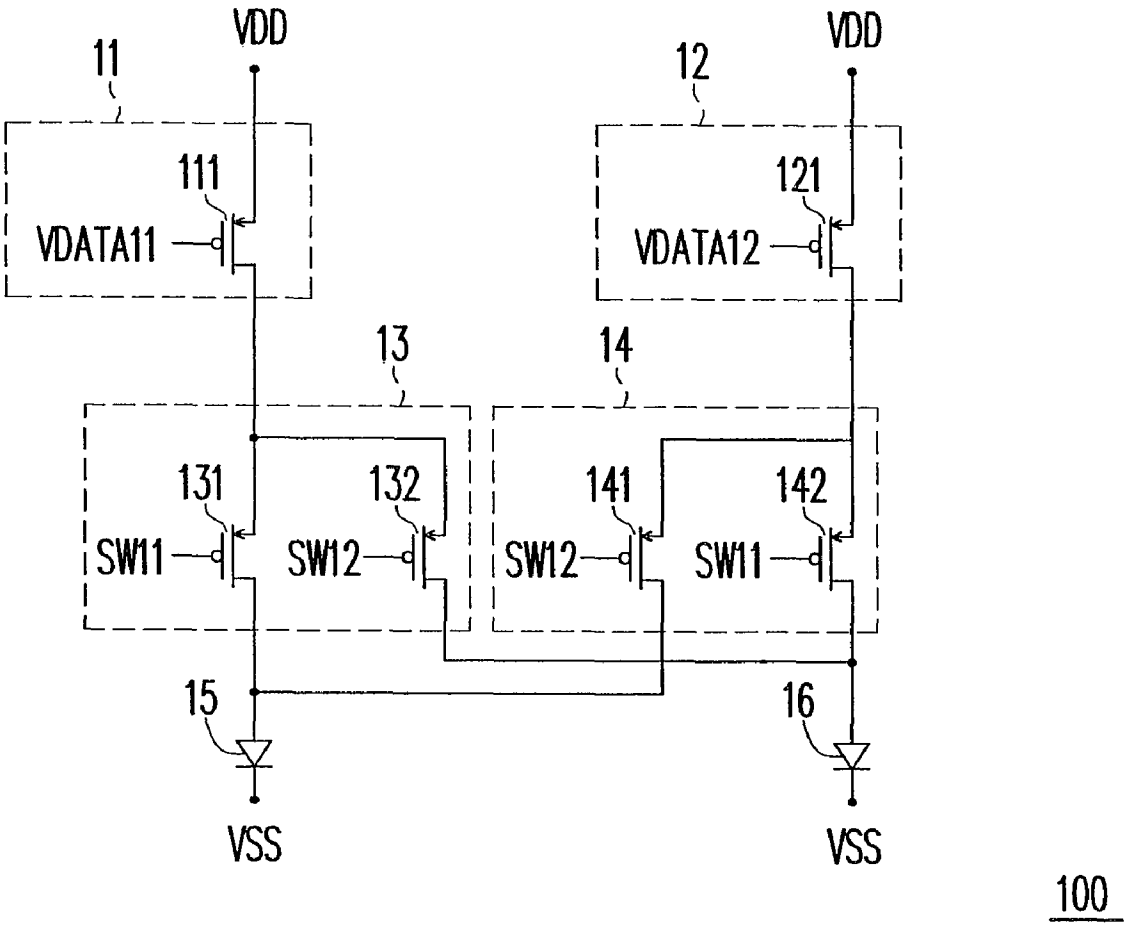
FIG. 1 is a circuit diagram of a pixel group of a pixel array according to a first embodiment of the present invention.

The present invention will now be described with reference to the accompanying drawings, in which exemplary embodiments of the invention are shown. The invention may, however, be embodied in many different forms and should not be construed as being limited to the embodiments set forth herein. Furthermore, the embodiments are provided so that this disclosure will be thorough and complete, and will fully convey the concept of the invention to those skilled in the art. OLED is taken as an example in the embodiments to illustrate the operating principle of the present invention. However, the embodiments of the present invention are not limited to the OLED, i.e., any light emitting elements in this field is also suitable to be used in the present invention, such as AMOLED (active matrix organic light emitting diode) and LED.

In the drawings, whenever the same element reappears in subsequent drawings, it is denoted by the same reference numeral.

FIG. 1 is a circuit diagram of a pixel group of a pixel array according to a first embodiment of the present invention. The pixel array is divided to a plurality of pixel groups. A pixel group 100 includes driving units 11 and 12, switching units 13 and 14, and OLEDs 15 and 16. The driving unit 11 includes a PMOS transistor 111 and the driving unit 12 includes a PMOS transistor 121. The switching unit 13 includes PMOS transistors 131 and 132 and the switching unit 14 includes PMOS transistors 141 and 142. The transistor 111 receives the data signal VDATA11 to generate and to output driving currents for the OLEDs 15 and 16. The transistor 121 receives the data signal VDATA12 to generate and to output driving currents for the OLEDs 15 and 16. The transistor 131 receives the switching signal SW11 and the transistor 132 receives the switching signal SW12. The transistor 141 receives the switching signal SW12 and the transistor 142 receives the switching signal SW11. The driving unit 11 and the driving unit 12 are powered by a supply voltage VDD. The cathodes of the OLEDs 15 and 16 are coupled to a ground voltage VSS.

Those skilled in the art should understand that the transistors are not limited to PMOS transistors, but also may be NMOS transistors or BJTs (bipolar junction transistors.

Figure 2:
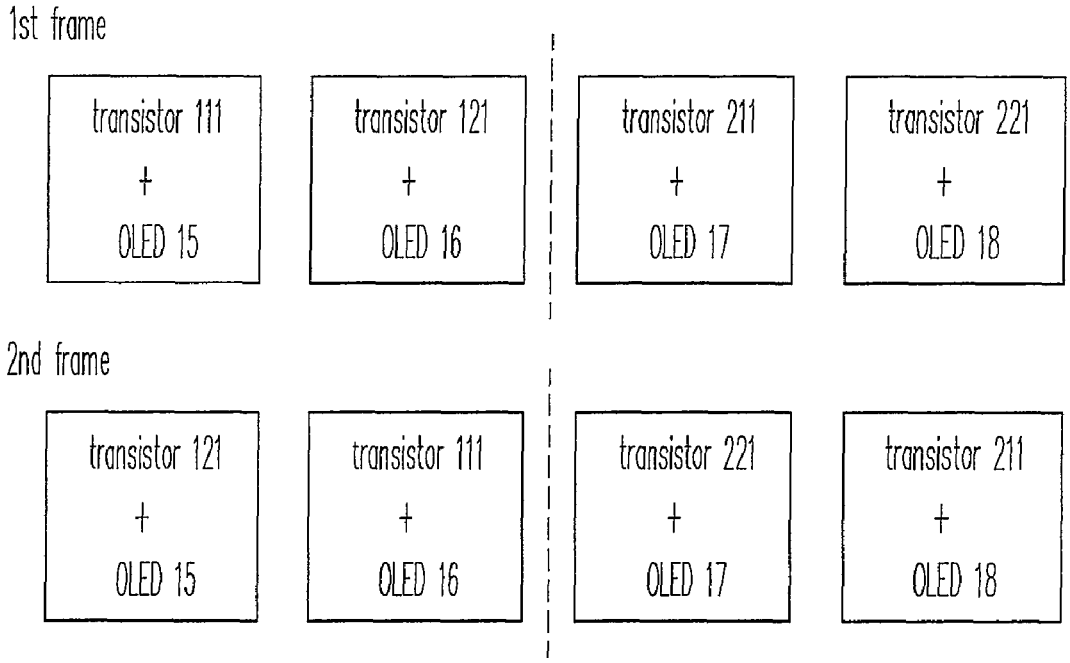
FIG. 2 shows the intra-pixel convolution of the pixel array illustrated in FIG. 1.

FIG. 2 shows the intra-pixel convolution of the pixel array illustrated in FIG. 1. In a first frame, the transistor 111 outputs a driving current for the OLED 15 and the transistor 121 outputs a driving current for the OLED 16. The transistors 132 and 141 are turned off by the switching signal SW12 while the transistors 131 and 142 are turned on by the switching signal SW11. Thus, the OLEDs 15 and 16 are driven by the driving units 11 and 12 respectively. In the following second frame, the transistor 111 outputs a driving current for the OLED 16 and the transistor 121 outputs a driving current for the OLED 15. The transistors 132 and 141 are turned on by the switching signal SW12 while the transistors 131 and 142 are turned off by the switching signal SW11. Thus, the OLEDs 15 and 16 are driven by the driving units 12 and 11 respectively. The operation is similar for another pixel group 200, wherein the transistors 211 and 221 output driving currents for the OLEDs 17 and 18. Since each of the OLEDs in a pixel group are driven by different driving units in a convolution sequence, the threshold voltages and mobility of the driving transistors in the same pixel group are averaged so that the performance degradation resulting from the non-uniformity issue is alleviated.

Figure 3A:
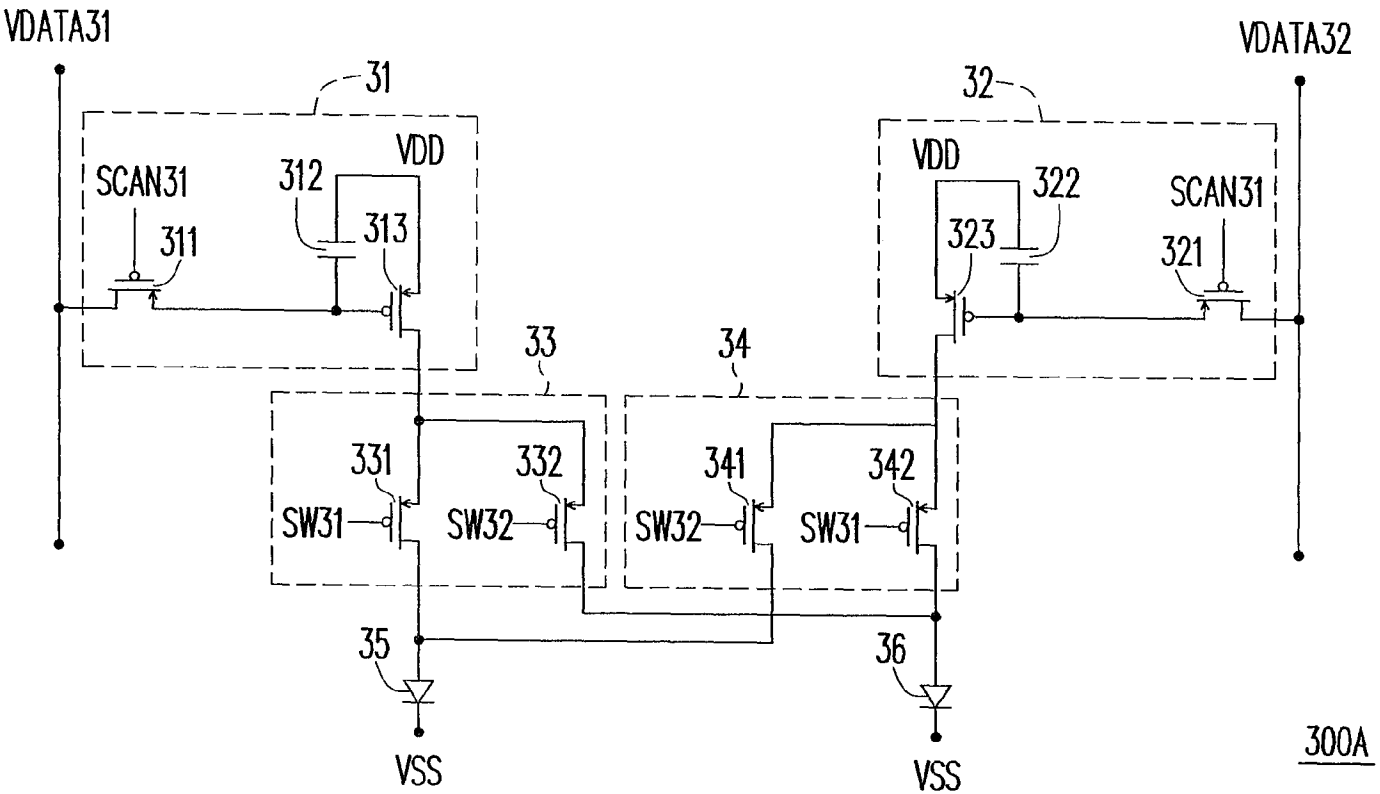
FIG. 3A is a circuit diagram of a pixel group of a pixel array according to a second embodiment of the present invention.

FIG. 3A is a circuit diagram of a pixel group of a pixel array according to a second embodiment of the present invention. The pixel array is divided to a plurality of pixel groups. A pixel group 300A includes driving units 31 and 32, switching units 33 and 34, and OLEDs 35 and 36. The driving units 31 and 32 of the pixel group 300A are commonly connected to a scan line to receive a scan signal SCAN31. The driving unit 31 includes transistors 311 and 313 and a capacitor 312. The capacitor 312 is connected to a source of the transistor 311 and a gate of the transistor 313. The driving unit 32 includes transistors 321 and 323 and a capacitor 322. The capacitor 322 is coupled to a source of the transistor 321 and a gate of transistor 323. The switching unit 33 includes transistors 331 and 332 and the switching unit 34 includes transistors 341 and 342. The transistor 311 receives the scan signal SCAN31 and a data signal VDATA31 to generate and to output driving currents for the OLEDs 35 and 36. The transistor 321 receives the scan signal SCAN31 and a data signal VDATA32 to generate and to output driving currents for the OLEDs 35 and 36. The transistor 331 receives a switching signal SW31 and the transistor 332 receives a switching signal SW32. The transistor 341 receives the switching signal SW32 and the transistor 342 receives the switching signal SW31. The switching unit 33 and the switching unit 34 are electrically connected to the anodes of the OLEDs 35 and 36. The driving units 31 and 32 are coupled to a supply voltage VDD. The cathodes of the OLEDs 35 and OLED 36 are coupled to a ground voltage VSS.

Figure 3B:
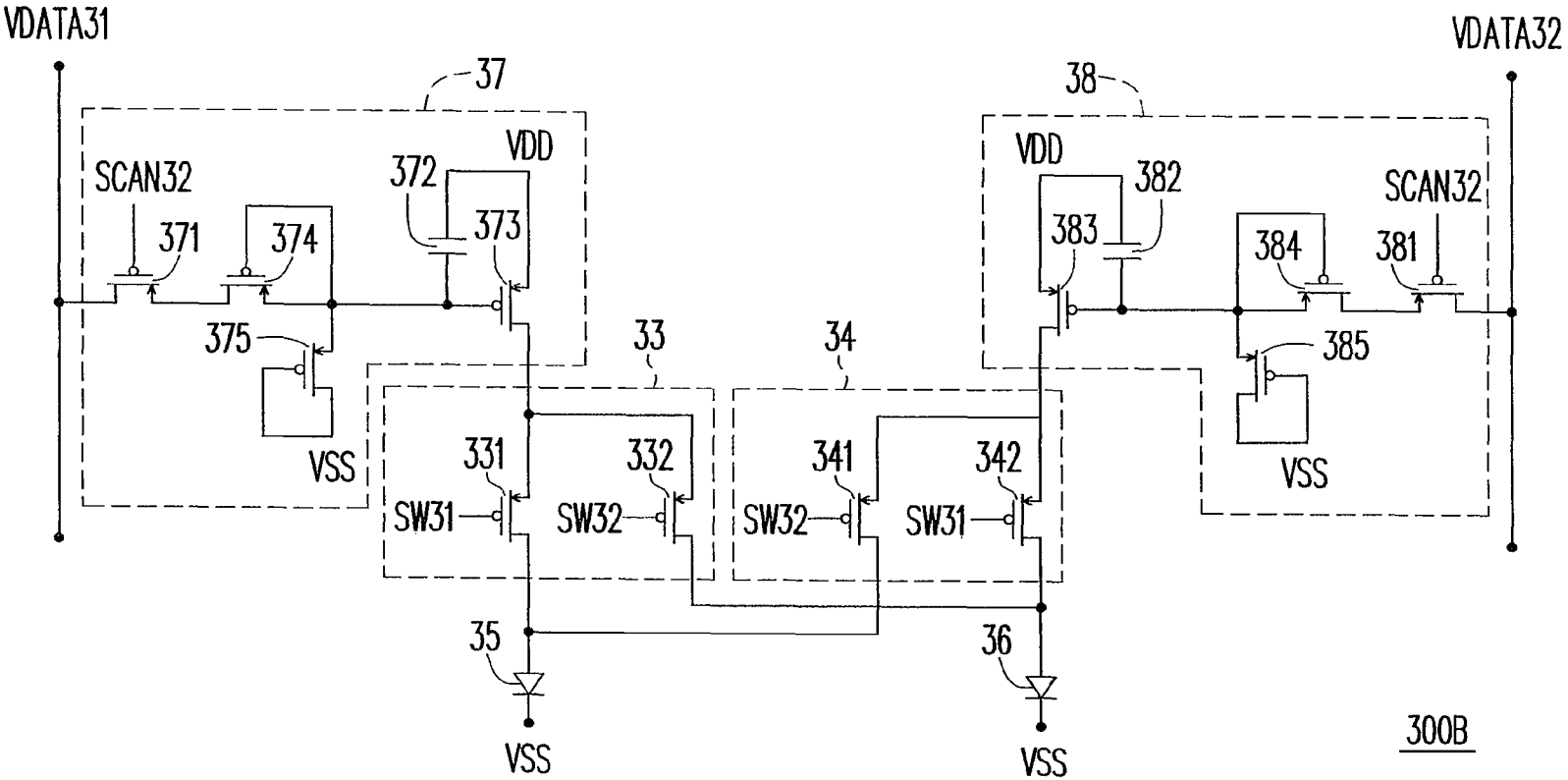
FIG. 3B is a circuit diagram of a pixel group of a pixel array according to a third embodiment of the present invention.

FIG. 3B is a circuit diagram of a pixel group of a pixel array according to a third embodiment of the present invention. A pixel group 300B includes driving units 37 and 38, switching units 33 and 34, and OLEDs 35 and 36. The driving unit 37 includes transistor 371, 373, 374, and 375 and a capacitor 372. The capacitor 372 is connected to a gate of the transistor 373 and a source of the transistor 374. The driving unit 38 includes transistors 381, 383, 384, and 385 and a capacitor 382 The transistor 371 receives a scan signal SCAN32 and a data signal VDATA31 to generate and to output driving currents for the OLEDs 35 and 36. The transistor 381 receives a scan signal SCAN32 and a data signal VDATA32 to generate and to output driving currents for the OLEDs 35 and 36. The capacitor 382 is connected to a gate of the transistor 383 and a source of the transistor 384. The switching unit 33 includes transistors 331 and 332 and the switching unit 34 includes transistors 341 and 342. The transistor 331 receives the switching signal SW31 and the transistor 332 receives the switching signal SW32. The transistor 341 receives the switching signal SW32 and the transistor 342 receives the switching signal SW31. The switching unit 33 and the switching unit 34 are electrically connected to the anodes of the OLEDs 35 and 36. The driving units 31 and 32 are coupled to a supply voltage VDD. The cathodes of the OLEDs 35 and 36 are coupled to a ground voltage VSS.

Figure 4:
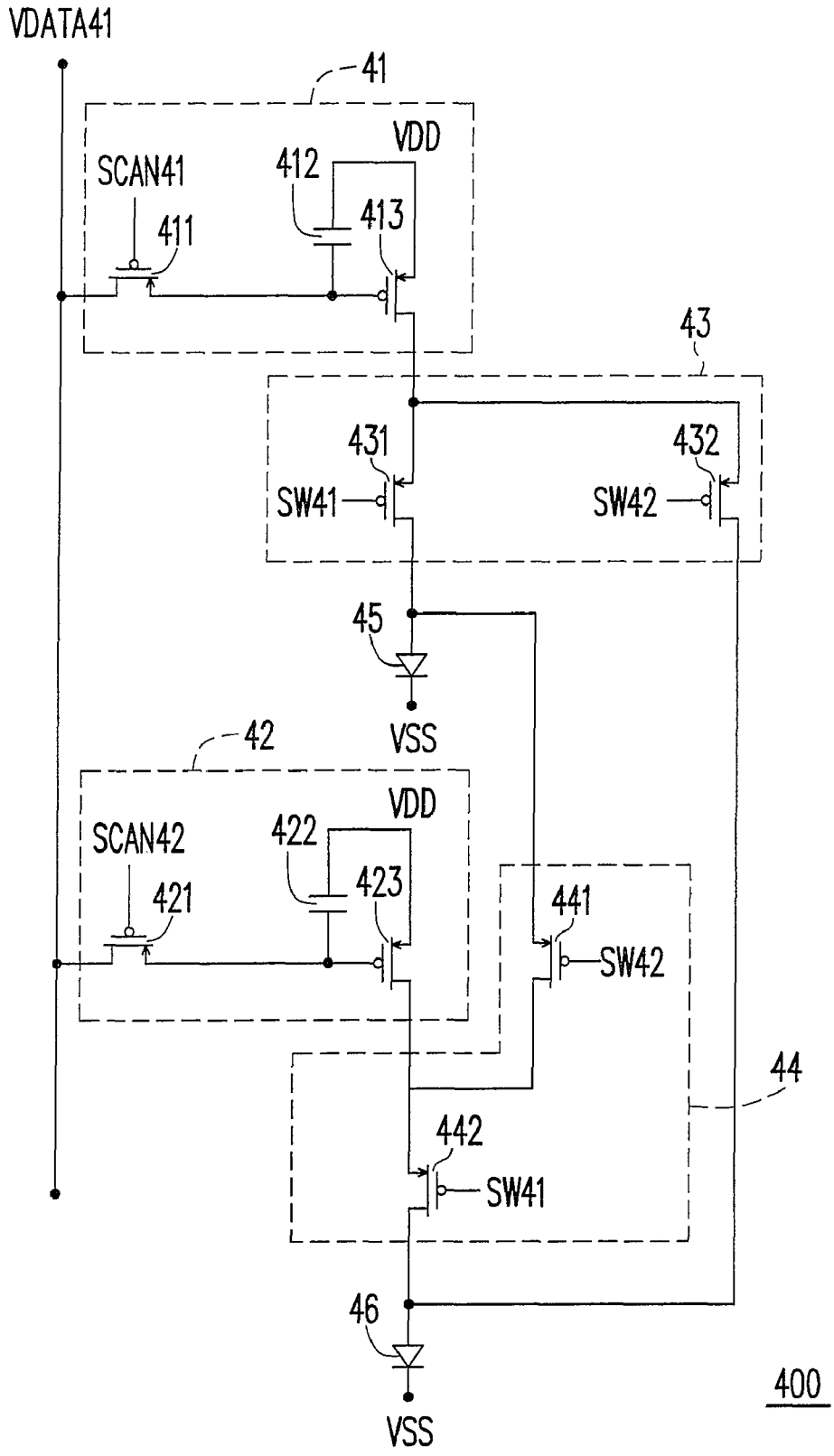
FIG. 4 is a circuit diagram of a pixel group of a pixel array according to a forth embodiment of the present invention.

FIG. 4 is a circuit diagram of a pixel group of a pixel array according to a forth embodiment of the present invention. The driving units 41 and 42 of the pixel group 400 are commonly connected to a data line to receive a data signal VDATA41. The pixel array is divided to a plurality of pixel groups. A pixel group 400 includes driving units 41 and 42, switching units 43 and 44 and OLEDs 45 and 46. The driving unit 41 includes transistors 411 and 413 and a capacitor 412. The capacitor 412 is connected to a source of the transistor 411 and a gate of the transistor 413. The driving unit 42 includes transistors 421 and 423 and a capacitor 422. The capacitor 422 is connected to a source of the transistor 421 and a gate of the transistor 423. The switching unit 43 includes transistors 431 and 432 and the switching unit 44 includes transistors 441 and 442. The transistor 411 receives a scan signal SCAN41 and the data signal VDATA41 to generate and to output driving currents for the OLEDs 45 and 46. The transistor 421 receives a scan signal SCAN42 and the data signal VDATA41 to generate and to output driving currents for the OLEDs 45 and 46. The transistor 431 receives a switching signal SW41 and the transistor 432 receives a switching signal SW42. The transistor 441 receives the switching signal SW42 and the transistor 442 receives the switching signal SW41. The switching units 43 and 44 are electrically connected the anodes of the OLEDs 45 and 46. The driving units 41 and 42 are coupled to a supply voltage VDD. The cathodes of the OLEDs 45 and 46 are coupled to a ground voltage VSS. However, the conventional pixel array reduces the quality of LCD panels.

Figure 5:
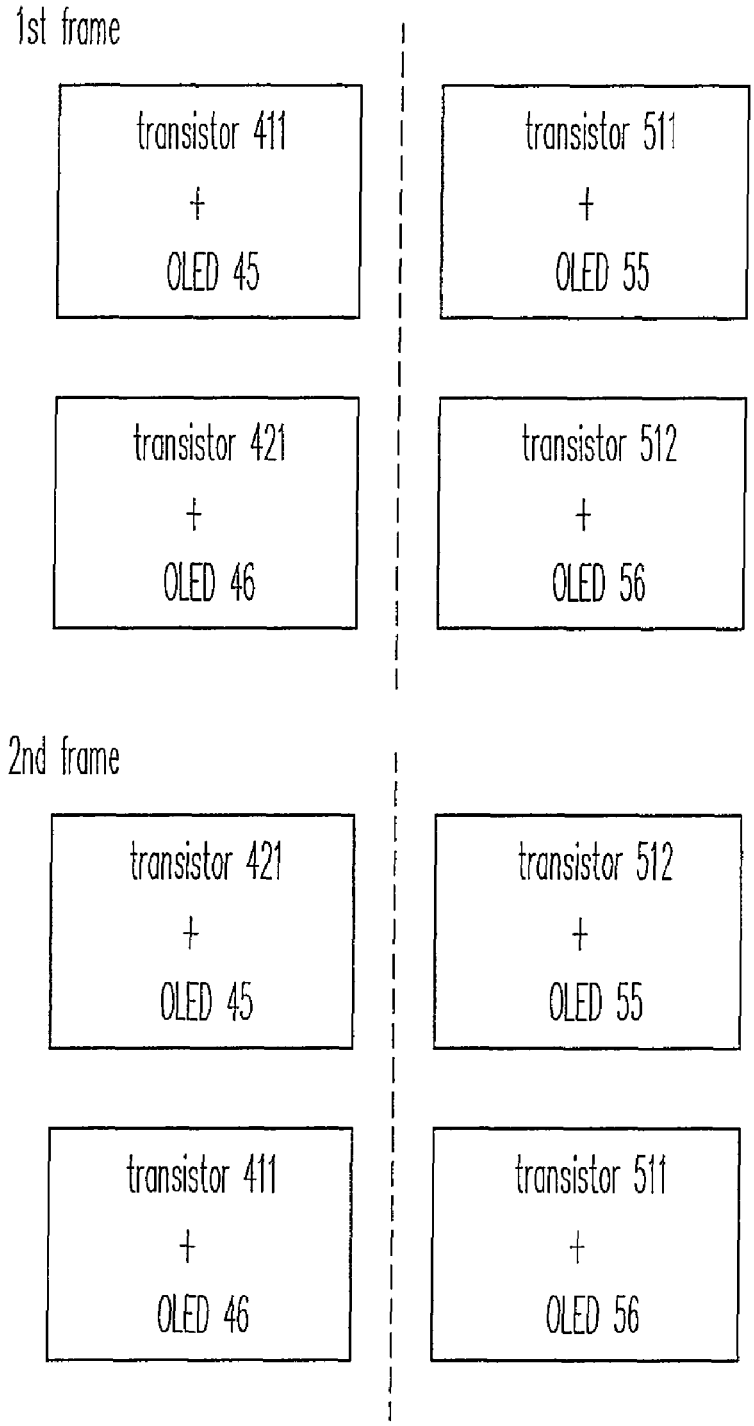
FIG. 5 shows the intra-pixel convolution of the pixel array illustrated in FIG. 4.

FIG. 5 shows the intra-pixel convolution of the pixel array illustrated in FIG. 4. In a first frame, the transistor 411 outputs a driving current for the OLED 45 and the transistor 421 outputs a driving current for the OLED 46. The transistors 432 and 441 are turned off by the switching signal SW42 while the transistors 431 and 442 are turned on by the switching signal SW41. Thus, the OLEDs 45 and 46 are driven by the driving units 41 and 42 respectively. In the following second frame, the transistor 411 outputs a driving current for the OLED 46 and the transistor 421 outputs a driving current for the OLED 45. The transistors 432 and 441 are turned on by the switching signal SW42 while the transistors 431 and 442 are turned off by the switching signal SW41. Thus, the OLEDs 45 and 46 are driven by the driving units 42 and 41 respectively. The operation is similar for another pixel group, wherein the transistors 511 and 512 output driving currents for the OLEDs 55 and 56.

Figure 6:
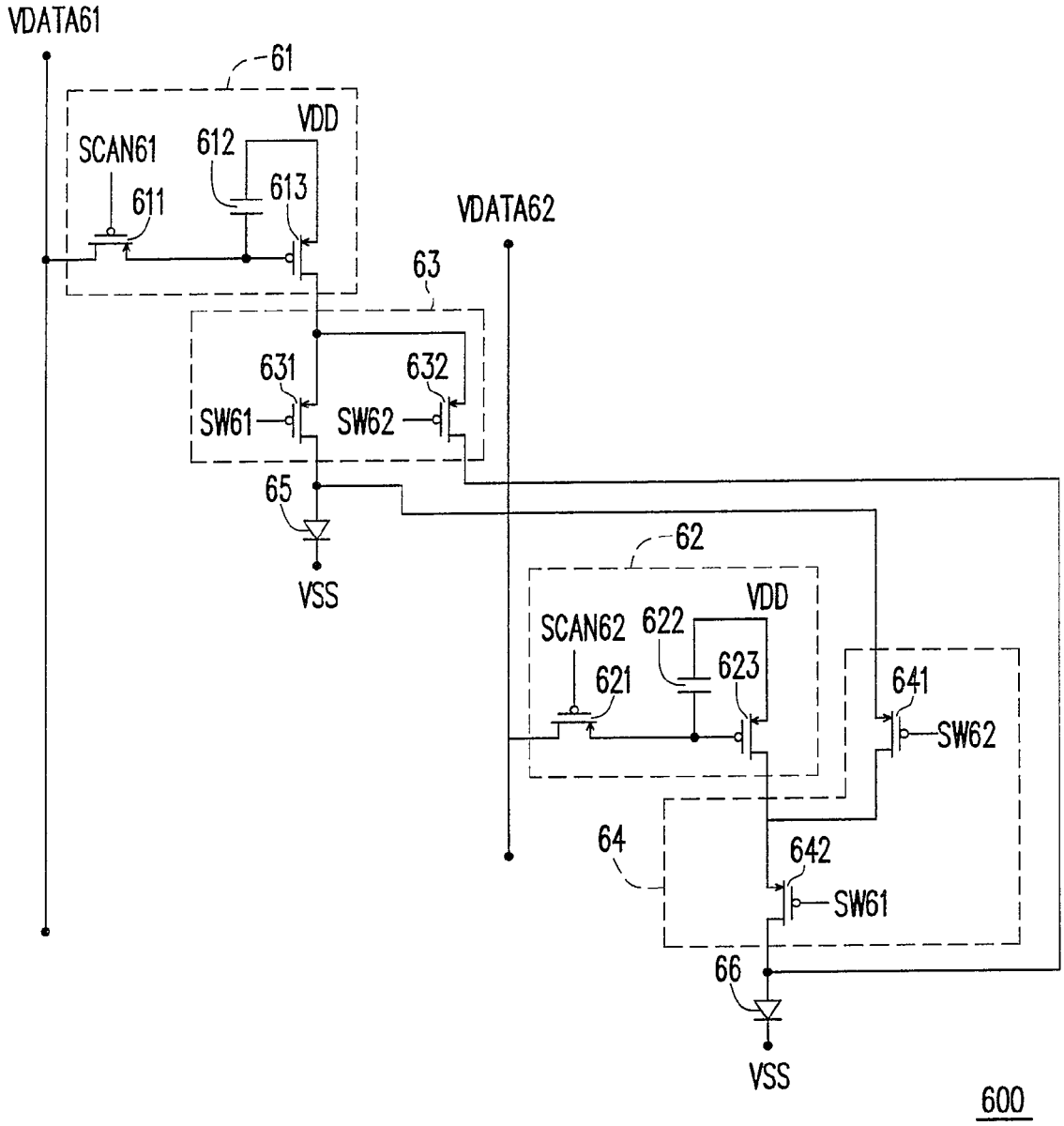
FIG. 6 is a circuit diagram of a pixel group of a pixel array according to a fifth embodiment of the present invention.

FIG. 6 is a circuit diagram of a pixel group of a pixel array according to a fifth embodiment of the present invention. The pixel array is divided to a plurality of pixel groups. A pixel group 600 includes driving units 61 and 62, switching units 63 and 64 and OLEDs 65 and 66. The driving unit 61 includes transistors 611 and 613 and a capacitor 612. The capacitor 612 is connected to a source of the transistor 611 and a gate of the transistor 613. The driving unit 62 includes transistors 621 and 623 and a capacitor 622. The capacitor 622 is coupled to a source of the transistor 621 and a gate of the transistor 623. The switching unit 63 includes transistors 631 and 632 and the switching unit 64 includes transistors 641 and 642. The transistor 611 receives a scan signal SCAN61 a data signal VDATA61 to generate and to output driving currents for the OLEDs 65 and 66. The transistor 621 receives a scan signal SCAN62 and a data signal VDATA62 to generate and to output driving currents for the OLEDs 65 and 66. The transistor 631 receives a switching signal SW61 and the transistor 632 receives a switching signal SW62. The transistor 641 receives the switching signal SW62 and the transistor 642 receives the switching signal SW61. The switching units 63 and 64 are electrically connected the anodes of the OLEDs 65 and 66. The driving units 61 and 62 are coupled to a supply voltage VDD. The cathodes of the OLEDs 65 and 66 are coupled to a ground voltage VSS. However, the conventional pixel array reduces the quality of LCD panels.

Figure 7:
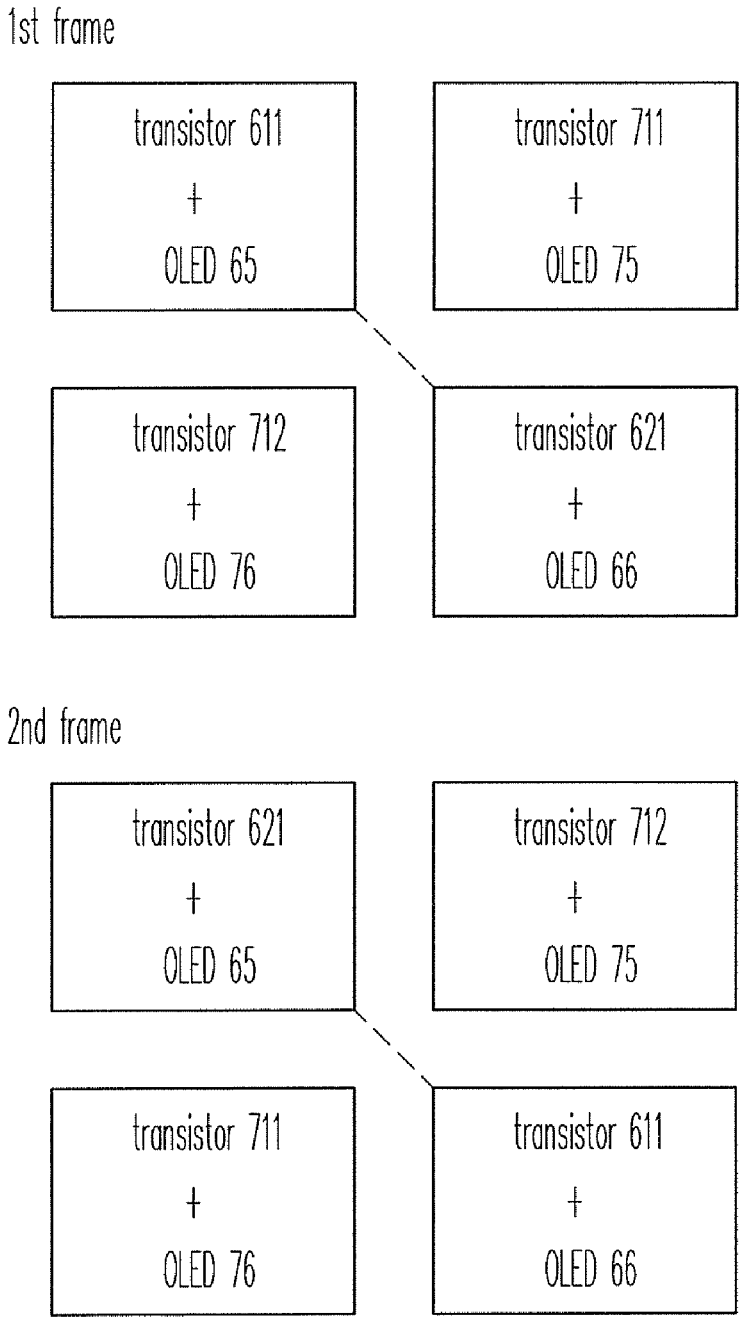
FIG. 7 shows the intra-pixel convolution of the pixel array illustrated in FIG. 6.

FIG. 7 shows the intra-pixel convolution of the pixel array illustrated in FIG. 6. In a first frame, the transistor 611 outputs a driving current for the OLED 65 and the transistor 621 outputs a driving current for the OLED 66. The transistors 632 and 641 are turned off by the switching signal SW62 while the transistors 631 and 642 are turned on by the switching signal SW61. Thus, the OLEDs 65 and 66 are driven by the driving units 61 and 62 respectively. In the following second frame, the transistor 611 outputs a driving current for the OLED 66 and the transistor 621 outputs a driving current for the OLED 65. The transistors 632 and 641 are turned on by the switching signal SW62 while the transistors 631 and 642 are turned off by the switching signal SW61. Thus, the OLEDs 65 and 66 are driven by the driving units 62 and 61 respectively. The operation is similar for another pixel group, wherein the transistors 711 and 712 output driving currents for the OLEDs 75 and 76.

Figure 8:
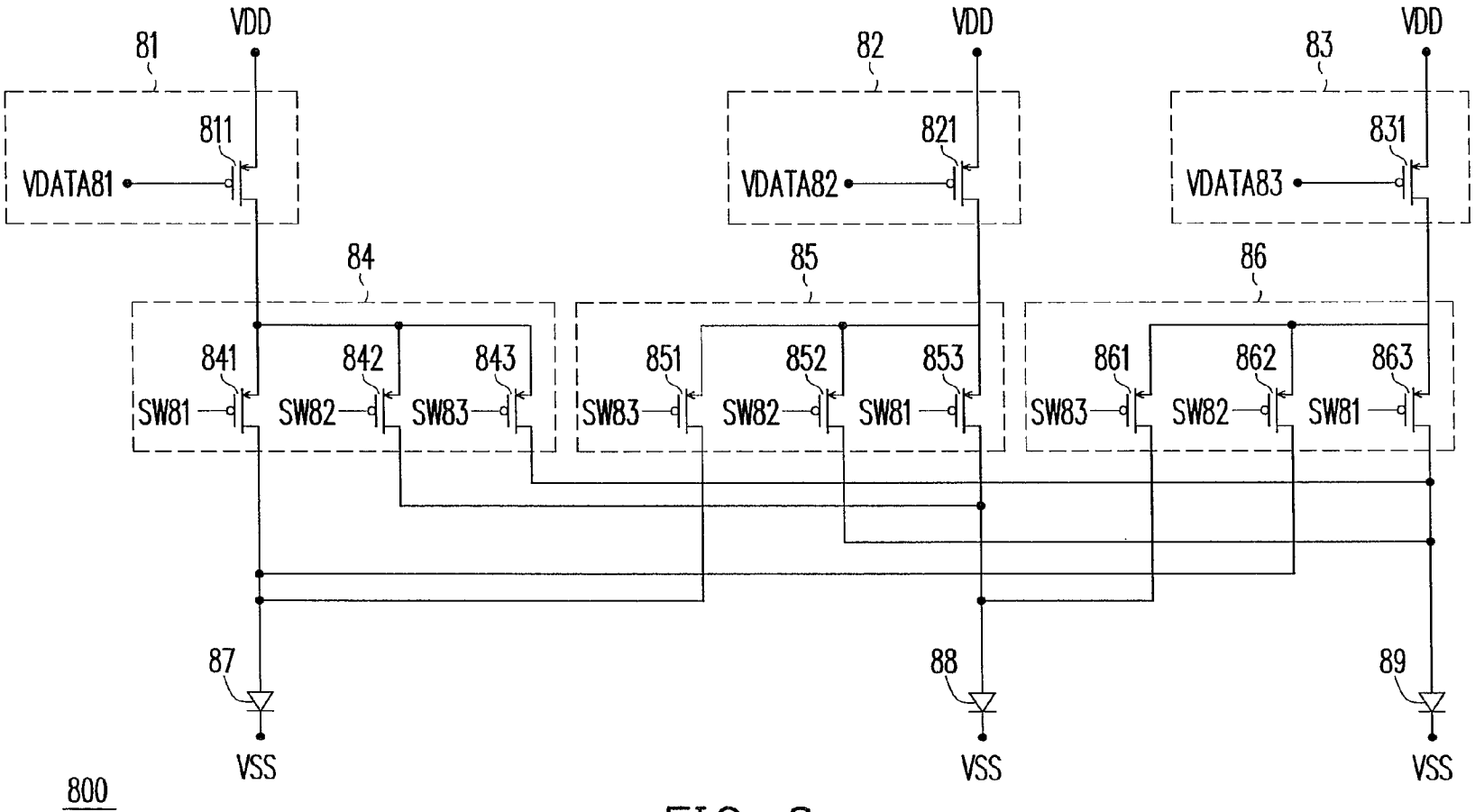
FIG. 8 is a circuit diagram of a pixel group of a pixel array according to a sixth embodiment of the present invention.

FIG. 8 is a circuit diagram of a pixel group of a pixel array according to a sixth embodiment of the present invention. The pixel array is divided to a plurality of pixel groups. A pixel array 800 includes driving units 81, 82, and 83, switching units 84, 85, and 86, and OLEDs 87, 88, and 89. The driving unit 81 includes a transistor 811, the driving unit 82 includes a transistor 821, and the driving unit 83 includes a transistor 831. The transistor 811 receives a data signal VDATA81 to generate and to output driving currents for the OLED 87, 88, and 89. The transistor 821 receives a data signal VDATA82 to generate and to output driving currents for the OLED 87, 88, and 89. The transistor 831 receives a data signal VDATA 83 to generate and to output driving currents for the OLED 87, 88, and 89. The switching unit 84 includes transistors 841 842, and 843. The switching unit 85 includes transistors 851, 852, and 853. The switching unit 86 includes transistors 861, 862, and 863. The transistors 841, 853, and 863 receive a switching signal SW81. The transistors 842, 852, and 862 receive a switching signal SW82. The transistors 843, 851, and 861 receive a switching signal SW83. The switching units 84, 85, and 86 are electrically connected the anodes of the OLEDs 87, 88, and 89. The driving units 81, 82, and 83 are coupled to a supply voltage VDD. The cathodes of the OLEDs 87, 88, and 89 are coupled to a ground voltage VSS.

Figure 9:
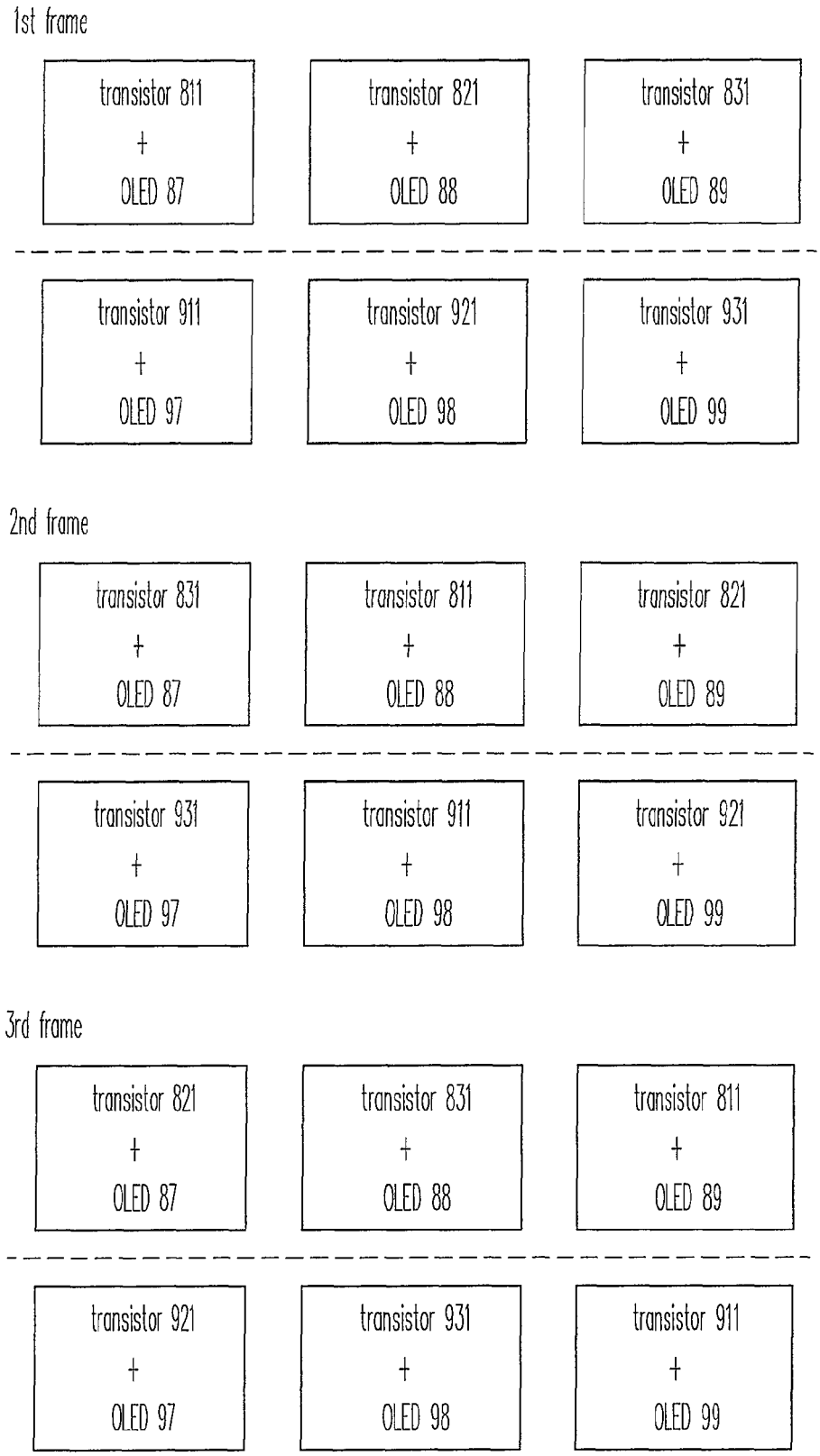
FIG. 9 shows the intra-pixel convolution of the pixel array illustrated in FIG. 8.

FIG. 9 shows the intra-pixel convolution of the pixel array illustrated in FIG. 8. In a first frame, the transistor 841 outputs a driving current for the OLED 87, the transistor 853 outputs a driving current for the OLED 88 and the transistor 863 outputs a driving current for the OLED 89. The transistors 842, 852 and 862 are turned off by the switching signal SW82, and the transistors 843,851 and 861 are turned off by the switching signal SW83 while the transistors 841, 853 and 863 are turned on by the switching signal SW81. Thus, the OLEDs 87, 88 and 89 are driven by the driving units 81, 82 and 83 respectively. In the second frame, the transistor 842 outputs a driving current for the OLED 88, the transistor 852 outputs a driving current for the OLED 89 and the transistor 862 outputs a driving current for the OLED 87. The transistors 841, 853 and 863 are turned off by the switching signal SW81, and the transistors 843,851 and 861 are turned off by the switching signal SW83 while the transistors 842, 852 and 862 are turned on by the switching signal SW82. Thus, the OLEDs 87, 88 and 89 are driven by the driving units 83, 81 and 82 respectively.

In the third frame, the transistor 843 outputs a driving current for the OLED 89, the transistor 851 outputs a driving current for the OLED 87 and the transistor 861 outputs a driving current for the OLED 88. The transistors 841, 853 and 863 are turned off by the switching signal SW81, and the transistors 842, 852 and 862 are turned off by the switching signal SW82 while the transistors 843, 851 and 861 are turned on by the switching signal SW83. Thus, the OLEDs 87, 88 and 89 are driven by the driving units 82, 83 and 81 respectively. The operation is similar for another pixel group, wherein the transistors 911, 921 and 931 output driving currents for the OLEDs 97, 98 and 99.

Figure 10A:
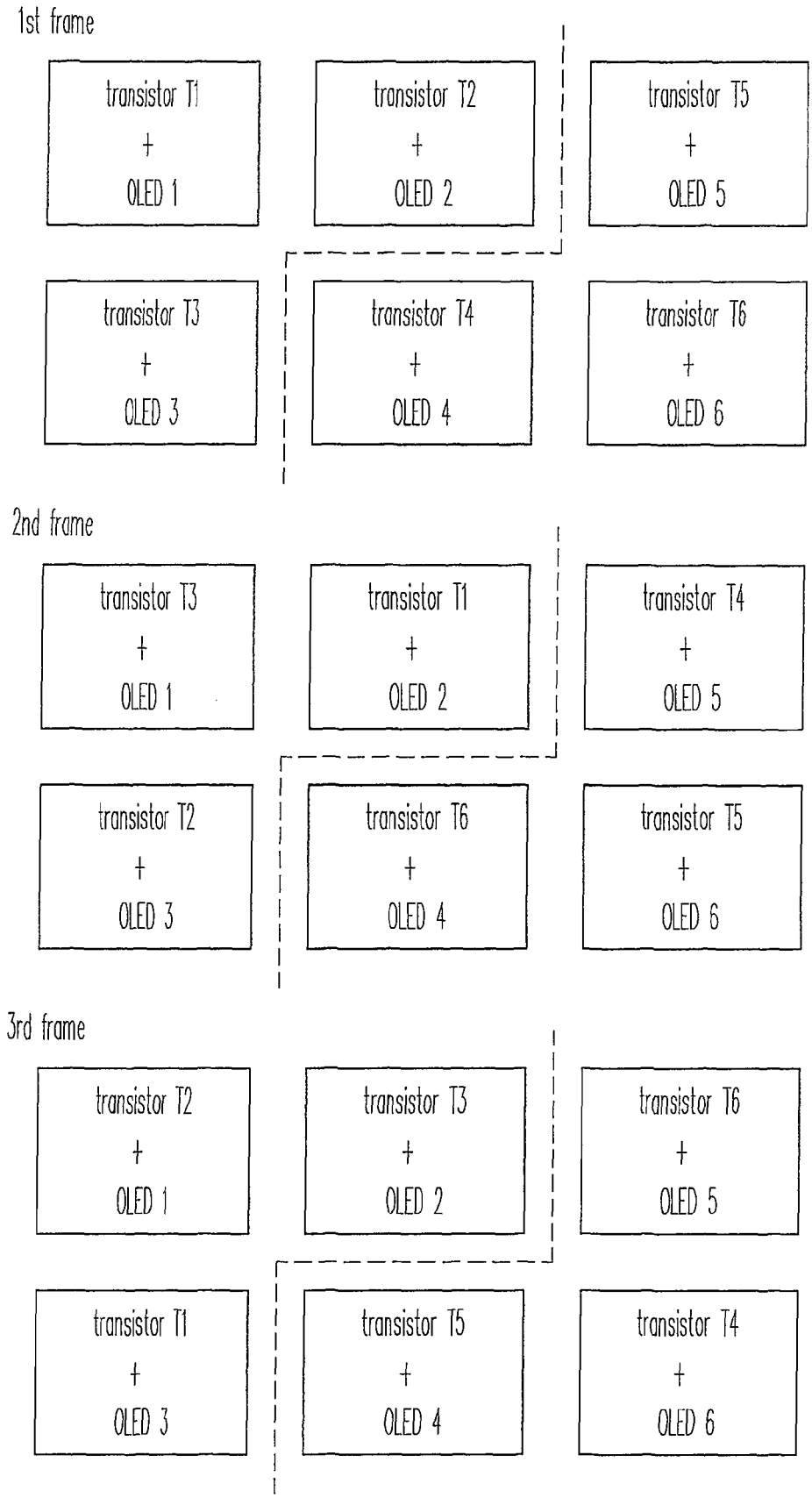
FIG. 10A shows the intra-pixel convolution of a pixel array according to a seventh embodiment of the present invention.

FIG. 10A shows the intra-pixel convolution of a pixel array according to a seventh embodiment of the present invention. The number of the driving units of the pixel group is 3, and the 3 driving units of each pixel group are connected to three adjacent data lines and two adjacent scan lines. In a first frame, the transistor T1 outputs a driving current for the OLED 1, the transistor T2 outputs a driving current for the OLED 2 and the transistor T3 outputs a driving current for the OLED 3. In the second frame, the transistor T3 outputs a driving current for the OLED 1, the transistor T1 outputs a driving current for the OLED 2 and the transistor T2 outputs a driving current for the OLED 3. In the third frame, the transistor T2 outputs a driving current for the OLED 1, the transistor T3 outputs a driving current for the OLED 2 and the transistor T1 outputs a driving current for the OLED 3. The operation is similar for another pixel group, wherein the transistors T4, T5 and T6 output driving currents for the OLEDs 4, 5 and 6.

Figure 10B:
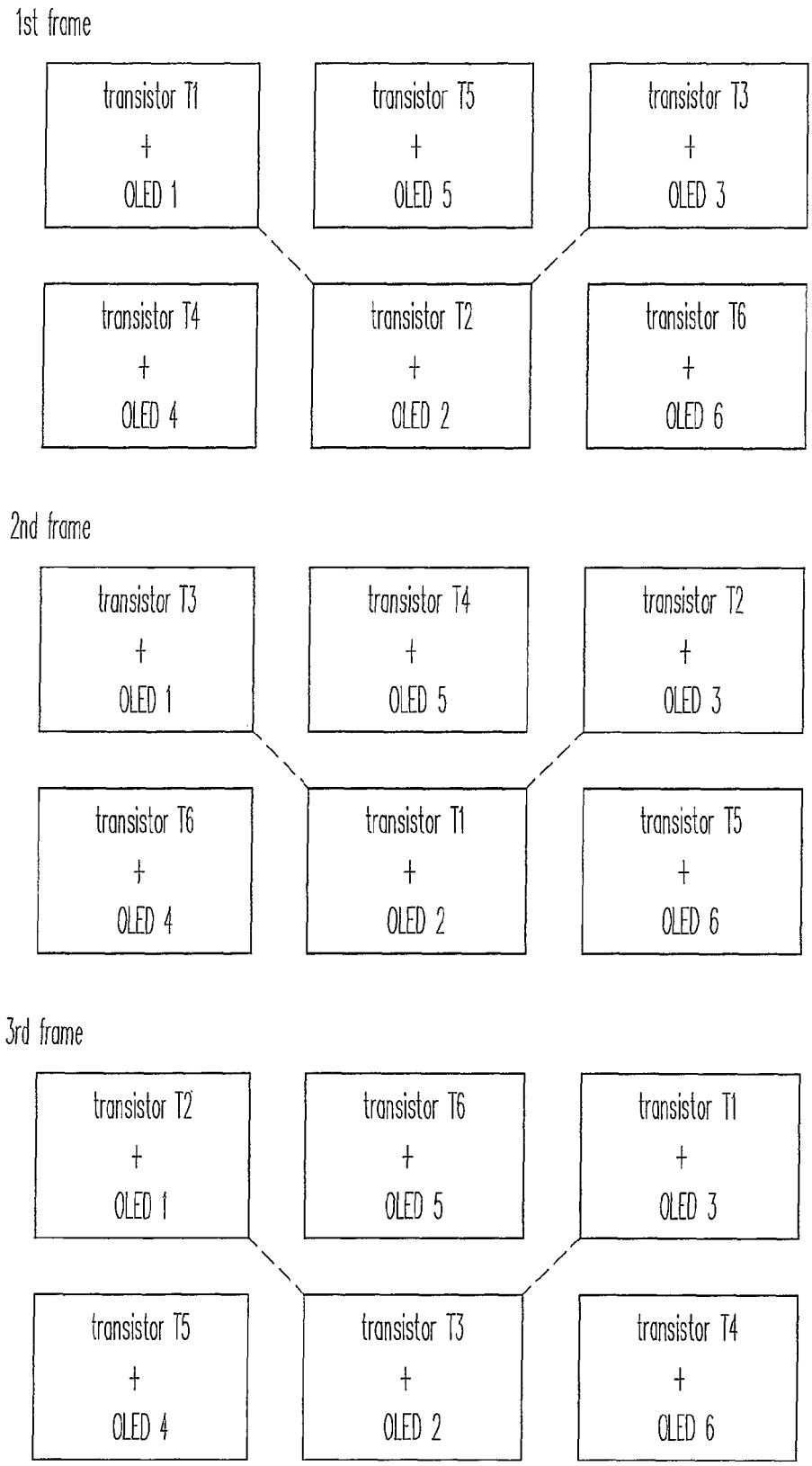
FIG. 10B shows the intra-pixel convolution of a pixel array according to an eighth embodiment of the present invention.

FIG. 10B shows the intra-pixel convolution of a pixel array according to an eighth embodiment of the present invention. The number of the driving units of the pixel group is 3, and the 3 driving units of each pixel group are connected to three adjacent data lines and two adjacent scan lines. In a first frame, the transistor T1 outputs a driving current for the OLED 1, the transistor T2 outputs a driving current for the OLED 2 and the transistor T3 outputs a driving current for the OLED 3. In the second frame, the transistor T3 outputs a driving current for the OLED 1, the transistor T1 outputs a driving current for the OLED 2 and the transistor T2 outputs a driving current for the OLED 3. In the third frame, the transistor T2 outputs a driving current for the OLED 1, the transistor T3 outputs a driving current for the OLED 2 and the transistor T1 outputs a driving current for the OLED 3. The operation is similar for another pixel group, wherein the transistors T4, T5 and T6 output driving currents for the OLEDs 4, 5 and 6.

Figure 10C:
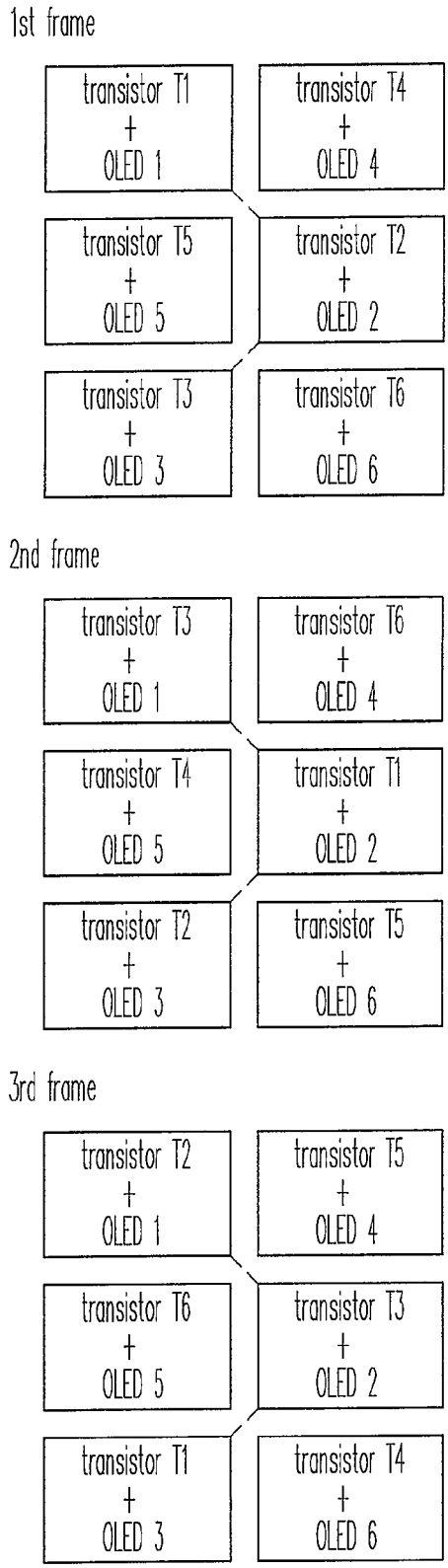
FIG. 10C shows the intra-pixel convolution of a pixel array according to a ninth embodiment of the present invention.

FIG. 10C shows the intra-pixel convolution of a pixel array according to a ninth embodiment of the present invention. The number of the driving units of the pixel group is 3, and the 3 driving units of each pixel group are connected to two adjacent data lines and three adjacent scan lines. In a first frame, the transistor T1 outputs a driving current for the OLED 1, the transistor T2 outputs a driving current for the OLED 2 and the transistor T3 outputs a driving current for the OLED 3. In the second frame, the transistor T3 outputs a driving current for the OLED 1, the transistor T1 outputs a driving current for the OLED 2 and the transistor T2 outputs a driving current for the OLED 3. In the third frame, the transistor T2 outputs a driving current for the OLED 1, the transistor T3 outputs a driving current for the OLED 2 and the transistor T1 outputs a driving current for the OLED 3. The operation is similar for another pixel group, wherein the transistors T4, T5 and T6 output driving currents for the OLEDs 4, 5 and 6.

To sum up, as each of the switching units coupling the pixel array in the convolution sequence, the intra-pixel convolution for AMOLED balances the threshold voltage and reduces the mobility variation.

Though the present invention has been disclosed above by the preferred embodiments, they are not intended to limit the invention. Anybody skilled in the art can make some modifications and variations without departing from the spirit and scope of the invention. Therefore, the protecting range of the invention falls in the appended claims.

What is claimed is:

1. A pixel array comprising a plurality of pixel groups, wherein each pixel group comprises:

a plurality of light emitting diodes;

a plurality of driving units, each of which outputs driving currents for the light emitting diodes in a convolution sequence, wherein the convolution sequence comprises a $1^{st}$ driving unit of the driving units outputting the driving current for a $1^{st}$ light emitting diode of the light emitting diodes while a $2^{nd}$ driving unit of the driving units outputs the driving current for a $2^{nd}$ light emitting diode of the light emitting diodes in a first frame, and then the 1st driving unit outputting the driving current for the $2^{nd}$ light emitting diode while the $2^{nd}$ driving unit outputting the driving current for the $1^{st}$ light emitting diode in a second frame; and a plurality of switching units, each of which couples the output of one of the driving units to the light emitting diodes in the convolution sequence, wherein each of the switching units comprises a plurality of switches having first ends commonly connected to the output of one of the driving units and second ends respectively connected to the light emitting diodes.

2. The pixel array as claimed in claim 1, wherein the driving units are connected to data and scan lines to receive data and scan signals so that the driving currents are generated in response to the data and scan signals.

3. The pixel array as claimed in claim 2, wherein each of the driving units comprises a first transistor having a gate receiving one of the data signals, a source connected to a first reference voltage, and a drain outputting one of the driving currents.

4. The pixel array as claimed in claim 3, wherein each of the driving units further comprises:

a second transistor having a gate receiving one of the scan signals and a drain receiving one of the data signals; and a capacitor connected between the gate and the source of the first transistor.

5. The pixel array as claimed in claim 4, wherein each of the driving units further comprises:

a third transistor having a source and gate commonly connected to the gate of the first transistor, a drain connected to the source of the second transistor; and a fourth transistor having a gate and drain commonly connected to receive a second reference voltage, and a source connected to the gate of the first transistor.

6. The pixel array as claimed in claim 5, wherein the first, second, third, and fourth transistors are PMOS transistors.

7. The pixel array as claimed in claim 5, wherein the first, second, third, and fourth transistors are NMOS transistors.

8. The pixel array as claimed in claim 5, wherein the first and second reference voltages are VDD and VSS respectively.

9. The pixel array as claimed in claim 1, wherein the switches are PMOS transistors.

10. The pixel array as claimed in claim 1, wherein the switches are NMOS transistors.

11. The pixel array as claimed in claim 2, wherein the driving units of each pixel group are connected to one of the data lines.

12. The pixel array as claimed in claim 2, wherein the driving units of each pixel group are connected to one of the scan lines.

13. The pixel array as claimed in claim 2, wherein the number of the driving units of each pixel group is 3, and the 3 driving units of each pixel group are connected to three adjacent data lines and two adjacent scan lines.

14. The pixel array as claimed in claim 2, wherein the number of the driving units of each pixel group is 3, and the 3 driving units of each pixel group are connected to two adjacent data lines and three adjacent scan lines.

15. The pixel array as claimed in claim 1, wherein the light emitting diodes are active matrix organic light emitting diodes.

16. A method for driving a display having a pixel array comprising a plurality of pixel groups, wherein each pixel group comprises a plurality of light emitting elements and a plurality of driving units, and the driving units are connected to data and scan lines to receive data and scan signals so that driving currents are generated in response to the data and scan signals, the method comprising the steps of:

outputting driving currents for the light emitting elements by the driving units in a convolution sequence; and coupling outputs of the driving units to the light emitting elements in the convolution sequence;

wherein the driving units of each pixel group are connected to three adjacent data lines and two adjacent scan lines.

17. A method for driving a display having a pixel array comprising a plurality of pixel groups, wherein each pixel group comprises a plurality of light emitting elements and a plurality of driving units, and the driving units are connected to data and scan lines to receive data and scan signals so that driving currents are generated in response to the data and scan signals, the method comprising the steps of:

outputting driving currents for the light emitting elements by the driving units in a convolution sequence; and coupling outputs of the driving units to the light emitting elements in the convolution sequence;

wherein the driving units of each pixel group are connected to two adjacent data lines and three adjacent scan lines.

* * * * *